US006131550A

United States Patent [19]

Fritz et al.

[11] Patent Number: 6,131,550

[45] Date of Patent: Oct. 17, 2000

[54] METHOD FOR CHECKING THE OPERABILITY OF A TANK-VENTING SYSTEM

[75] Inventors: Thorsten Fritz, Gaggenau; Andreas Blumenstock, Ludwigsburg, both of Germany

[73] Assignee: Robert Bosch GmbH, Stuttgart, Germany

[21] Appl. No.: 09/263,787

[22] Filed: Mar. 5, 1999

[30] Foreign Application Priority Data

Mar. 5, 1998 [DE] Germany ..... 198 09 384

[51] Int. Cl.[7] ..... F02M 33/02

[52] U.S. Cl. ..... 123/520; 123/198 D

[58] Field of Search ..... 123/198 D, 520, 123/519, 518, 516, 521

[56] References Cited

U.S. PATENT DOCUMENTS

| | | | |
|---|---|---|---|
| 5,297,529 | 3/1994 | Cook | 123/198 D |
| 5,349,935 | 9/1994 | Mezger | 123/198 D |
| 5,383,437 | 1/1995 | Cook | 123/198 D |
| 5,460,141 | 10/1995 | Denz | 123/198 D |
| 5,499,614 | 3/1996 | Busato | 123/198 D |
| 5,553,577 | 9/1996 | Denz | 123/198 D |
| 5,685,279 | 11/1997 | Bloomquist | 123/198 D |
| 5,715,799 | 2/1998 | Bloomquist | 123/198 D |
| 5,967,124 | 10/1999 | Cook | 123/198 D |

FOREIGN PATENT DOCUMENTS

| | | |
|---|---|---|
| 196 36 431 | 7/1997 | Germany . |
| 2291865 | 2/1996 | United Kingdom . |
| 2328516 | 2/1999 | United Kingdom . |
| WO94/27131 | 11/1994 | WIPO . |

*Primary Examiner*—Carl S. Miller
*Attorney, Agent, or Firm*—Walter Ottesen

[57] ABSTRACT

The invention is directed to a method for checking the operability of a tank-venting system of a motor vehicle. The tank-venting system includes a tank, an adsorption filter and a tank-venting valve. The adsorption filter has a venting line and is connected to the tank via a connecting line. The tank-venting valve is connected to the adsorption filter via a valve line. In the method, a pressure source introduces a pressure into the tank-venting system which is an overpressure compared to atmospheric pressure and the pressure source has at least one operating variable. A first time-dependent trace of the one variable is provided and this trace is characteristic for a diagnostic trace undisturbed by a tanking operation. A second time-dependent trace of the one variable is detected during standstill of the vehicle and is compared to the first time-dependent trace. An output of a fault announcement is inhibited when the second time-dependent trace deviates from the first time-dependent trace by a pregiven value.

5 Claims, 3 Drawing Sheets

I Reference Measurement
II Tank Measurement

METHOD FOR CHECKING THE OPERABILITY OF A TANK-VENTING SYSTEM

FIELD OF THE INVENTION

The invention relates to a method for checking the operability of a tank-venting system of a vehicle including a tank, an adsorption filter and a tank-venting valve. The adsorption filter has a venting line and is connected to the tank via a connecting line. The tank-venting valve is connected to the adsorption filter via a valve line. In the method, an overpressure compared to atmospheric pressure is introduced into the vessel by a pressure source and at least one operating characteristic variable is detected for determining a pressure trace and a conclusion is drawn therefrom as to the presence of a leak (tightness check). The operating variable is preferably detected at the pressure source when introducing the overpressure.

BACKGROUND OF THE INVENTION

A method and an arrangement of the above kind for checking the operability of a tank-venting system are disclosed in U.S. patent application Ser. No. 08/900,335, filed on Jul. 25, 1997. Such a diagnostic method can only supply reliable diagnostic results when the vehicle is at standstill. This is so because, for a moving vehicle, the ambient pressure can change (for example, when traveling in mountainous country) and this and, for example, fuel sloshing in the tank constitute disturbances which are too great.

A reliable leakage diagnosis can therefore only be executed for a vehicle at standstill. However, it cannot be excluded here that the vehicle has just been tanked full and a leak is signaled which is not present.

A method is disclosed in U.S. patent application Ser. No. 08/722,682, filed on Sep. 30, 1996, wherein one an conclude the presence of a tanking operation based on a pressure trace characteristic of a tanking operation.

It is problematic with respect to this method that a pressure sensor must be present in the tank which detects the pressure trace in the tank.

SUMMARY OF THE INVENTION

In view of the foregoing, it is an object of the invention to provide a method for checking the operability of the tank-venting system of a motor vehicle which is so improved that a conclusion can be drawn as to the presence of a tanking operation disturbing to the tightness check by detecting the operating characteristic variables of the pressure source.

The method of the invention is for checking the operability of a tank-venting system of a motor vehicle, the tank-venting system including a tank, an adsorption filter and a tank-venting valve. The adsorption filter has a venting line and is connected to the tank via a connecting line and the tank-venting valve is connected to the adsorption filter via a valve line. The method include the steps of: utilizing a pressure source to introduce a pressure into the tank-venting system which is an overpressure compared to atmospheric pressure and the pressure source having at least one operating variable; providing a first time-dependent trace of the one variable which is characteristic for a diagnostic trace undisturbed by a tanking operation; detecting a second time-dependent trace of the one variable during standstill of the vehicle; comparing the second time-dependent trace to the first time-dependent trace; and, inhibiting an output of a fault announcement when the second time-dependent trace deviates from the first time-dependent trace by a pregiven value.

It is possible to reliably detect tanking operations from the comparison of the detected time-dependent trace of the at least one characteristic variable of the pressure source to a previously determined diagnostic trace. For example, if, during a check of the operability of the tank-venting system, the tank cap is opened, the fill nozzle introduced and the vehicle tanked, then a pressure increase is determined in the tank-venting system which becomes manifest by a significant change of the operating characteristic variables of the pressure source. If, in contrast, during the diagnosis (that is, during the introduction of an overpressure via the tank source into the tank-venting system), the tank cap is opened, but the vehicle is not yet tanked, then the diagnostic overpressure is abruptly reduced which, in turn, becomes manifest by a significant change of the operating characteristic variable of the pressure source.

The second embodiment of the method of the invention is for checking the operability of a tank-venting system of a motor vehicle, the tank-venting system including a tank, an adsorption filter and a tank-venting valve. The adsorption filter has a venting line and is connected to the tank via a connecting line and the tank-venting valve is connected to the adsorption filter via a valve line. The method includes the steps of: utilizing a pressure source to introduce a pressure into the tank-venting system which is an overpressure compared to atmospheric pressure and the system or the pressure source having at least one operating variable which can be detected; providing a stored reference time-dependent trace of the one variable which is characteristic for a diagnostic trace; detecting the operating variable while introducing the overpressure during a first standstill of the vehicle to form a first time-dependent trace of the one variable and determining whether a leak is present; detecting the operating variable while introducing the overpressure during a second standstill of the vehicle to form a second time-dependent trace of the one variable and determining whether a leak is present; comparing the first and second time-dependent traces to the stored reference time-dependent trace; outputting a fault announcement only when:

(a) a conclusion is drawn as to the presence of a leak from both of the first and second time-dependent traces and when the first and second traces deviate from the stored reference time-dependent trace by a pregiven value; and, (b) when, between the first and second standstills of the vehicle, one of the following does not exceed a predetermined threshold:

(i) fuel consumption;

(ii) distance traveled; or, (iii) another index which permits a conclusion to be drawn that no tanking operation is taking place during the second standstill.

In this way, it is made advantageously possible, that even those leaks can be detected when there is an improper operation of the vehicle. For example, if the tank cap is opened before the start of the diagnosis and the actual tanking operation, that is, the input of fuel takes place later after completion of the diagnosis (that is, after introduction of the overpressure by the pressure source), a leak is detected in a first check of tightness but this leak is no longer determined in a second tightness check if no further tanking operation is present during this second tanking operation, that is, if the distance traveled, the fuel consumption or some other measure or index (which permits a conclusion to be drawn as to a tanking operation) does not exceed a pregiven threshold. Only when a leak is actually present, is a leak determined also in the second tightness check.

For this reason, a leak can also be detected when the operation of the vehicle is improper because of the tightness check during at least two sequential standstills of the vehicle, for example, when the tank was left open for a very long time.

The most different operating characteristic variables of the pressure source can be considered when detecting the time-dependent trace of the operating characteristic variables of the pressure source.

An especially advantageous embodiment provides that the electric current of an the overpressure pump is detected as a characteristic variable of the pressure source. With this detection of the current, not only significant changes of the operating state of the pressure source are precisely detected. The detected electric current can be advantageously processed in a simple manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
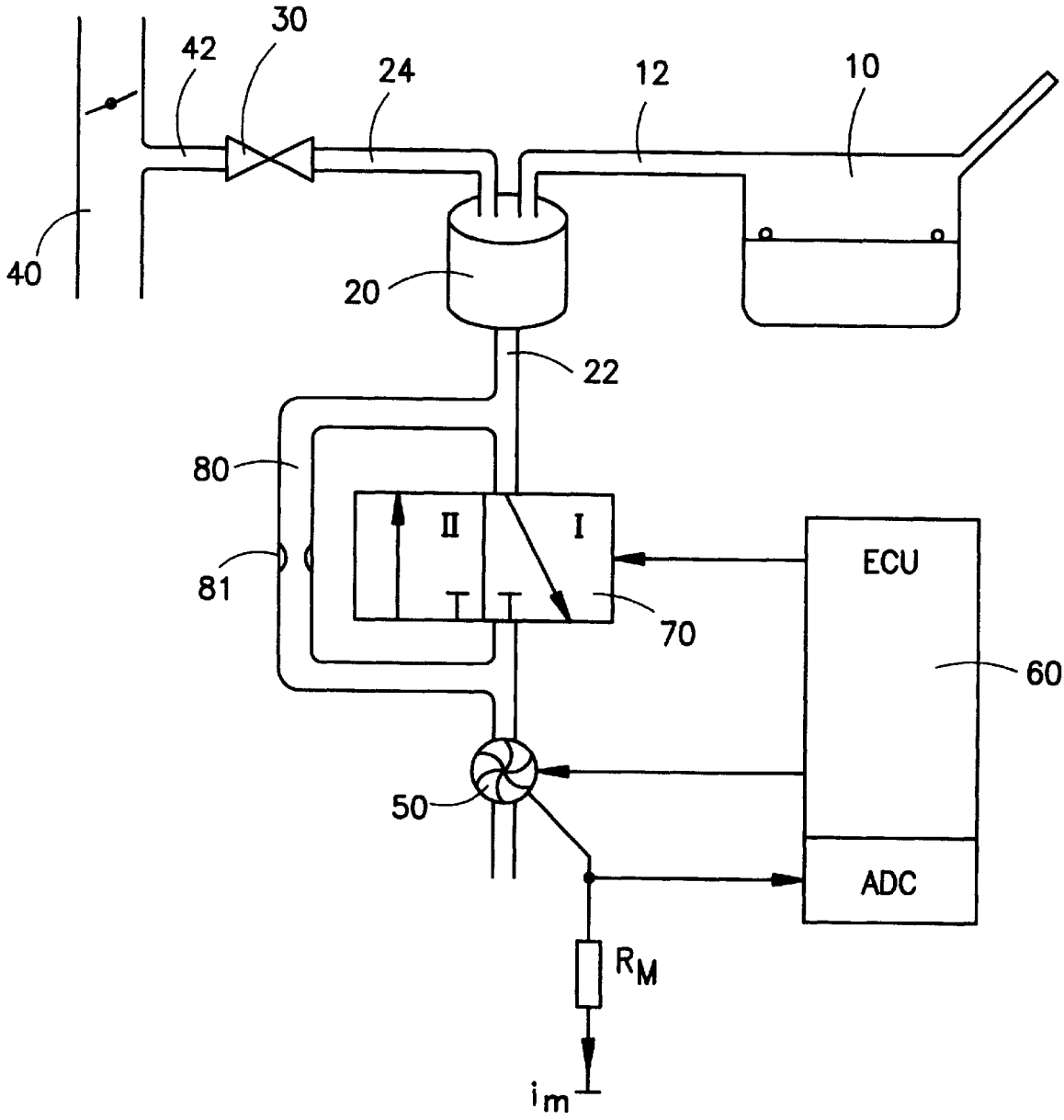
FIG. 1 is a schematic of a tank-venting system wherein the method of the invention is applied.

A tank-venting system of a motor vehicle tank system is shown in FIG. 1 and includes a tank 10, an adsorption filter 20 as well as a tank-venting valve 30. The adsorption filter 20 is, for example, an active charcoal filter which is connected to the tank 10 via a tank connecting line 12 and has a venting line 22, which can be connected to the ambient. The tank-venting valve 30 is, on the one hand, connected to the adsorption filter 20 via a valve line 24 and, on the other hand, to an intake manifold 40 of an internal combustion engine via a valve line 42.

Hydrocarbons develop in the tank 10 because of vaporization and deposit in the adsorption filter 20. To regenerate the adsorption filter 20, the tank-venting valve 30 is opened so that air of the atmosphere is inducted through the adsorption filter 20 because of the underpressure present in the intake manifold 40. In this way, hydrocarbon substances, which are deposited in the adsorption filter 20, are drawn by suction into the intake manifold 40 and are supplied to an internal combustion engine (not shown).

A pump 50 is provided and connected to a switching unit 60 in order to diagnose the operability of the tank-venting system. A switchover valve 70 is connected downstream of the pump 50 and is, for example, in the form of a 3/2 directional valve. A reference leak 81 is provided in a separate branch 80 parallel to this switchover valve 70. The size of the reference leak 81 is so selected that it corresponds to the size of the leak to be detected.

It is understood that reference leak 81 can, for example, also be part of the switchover valve 70 by providing a narrowing of the channel or the like so that, in this case, an additional reference component is not necessary (not shown)

The tightness check of the tank-venting system is explained in careful detail in U.S. patent application Ser. No. 08/900,335, filed on Jul. 25, 1997, and incorporated herein by reference. Here, by detecting the current flowing through the pump motor, a determination is made as to whether the pump flow which is to be introduced by the pressure source 50 into the tank-venting system, deviates from the pump flow which is present when introducing the overpressure via the reference leak.

Figure 2:
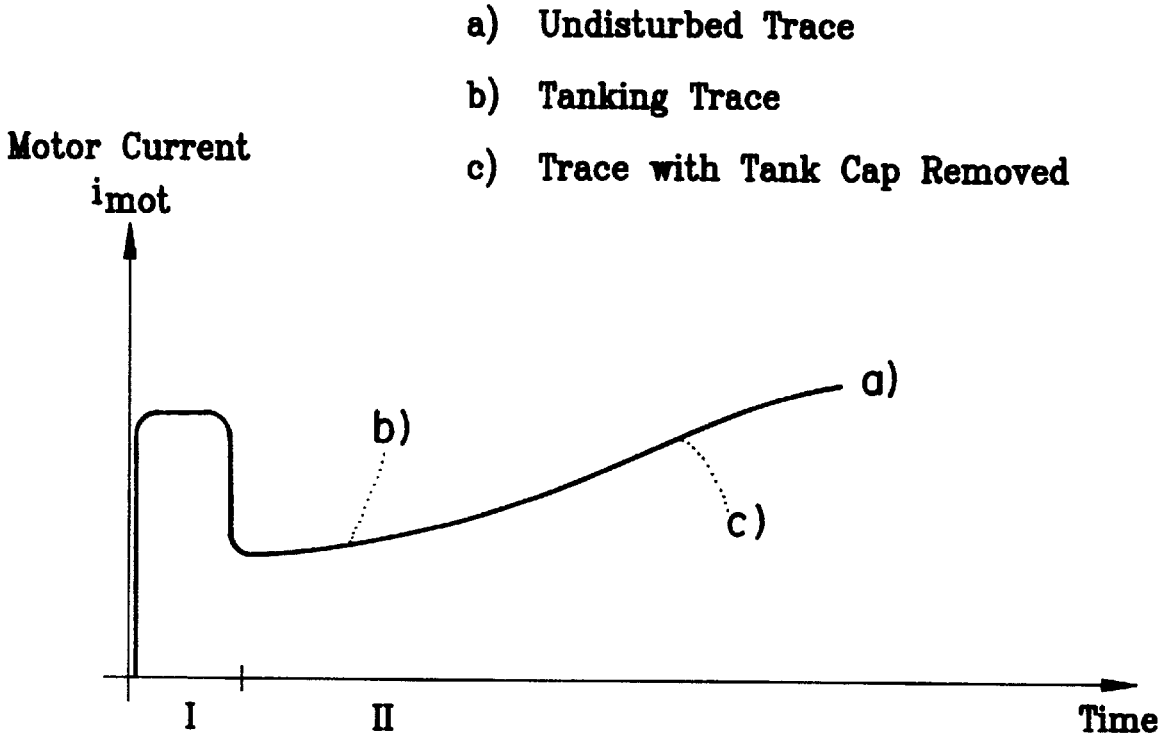
FIG. 2 is a graph showing the characteristic time-dependent trace of the electric current of the motor of the overpressure pump of the tank-venting system shown in FIG. 1; and, FIG. 3 is a schematic showing the time-dependent trace of the motor current of the overpressure pump of the tank-venting system of FIG. 1 for different operating states thereof.

FIG. 2 shows the time-dependent trace of the current which results when a voltage is applied to the motor of the pressure source 50, that is, to the overpressure source.

The trace identified by reference letter (a) corresponds to the time-dependent trace of the motor current $i_{mot}$ of a tank-venting system which is operational and without leakage. In the time segment identified by I, the switchover valve 70 is in the position identified by I in FIG. 1. In this position of the switchover valve 70, a pump flow is introduced into the tank-venting system by the pressure source 50 via the reference leak 81. In this way, an essentially constant current $i_{mot}$ adjusts as shown schematically in FIG. 2. As soon as the switchover valve 70 is switched over from position I to position II, the pressure source 50 charges the tank-venting system with an overpressure. During this switchover, the motor current $I_{mot}$ decreases rapidly and then increases continuously as a function of time until it reaches a value which is greater than or equal to the motor current $i_{mot}$ in the position I of the switchover valve 70. This time-dependent trace is identified by reference character (a) and is characteristic for an operational tank-venting system.

If, for example, a tanking operation takes place during the time in which the overpressure is introduced into the tank-venting system (position II of the switchover valve 70), the pressure in the tank-venting system increases so that the motor current $i_{mot}$ increases. This trace is shown schematically in FIG. 2 by the time-dependent trace identified by the dotted line (b).

In the opposite case, the motor current $i_{mot}$ decreases significantly if the tank cap is opened during a diagnosis as shown schematically in FIG. 2 by the time-dependent trace identified by the dotted line (c). In both cases, a possible leak present in the tank-venting system cannot be reliably detected. The diagnostic method is interrupted and a fault announcement is not outputted.

Figure 3:
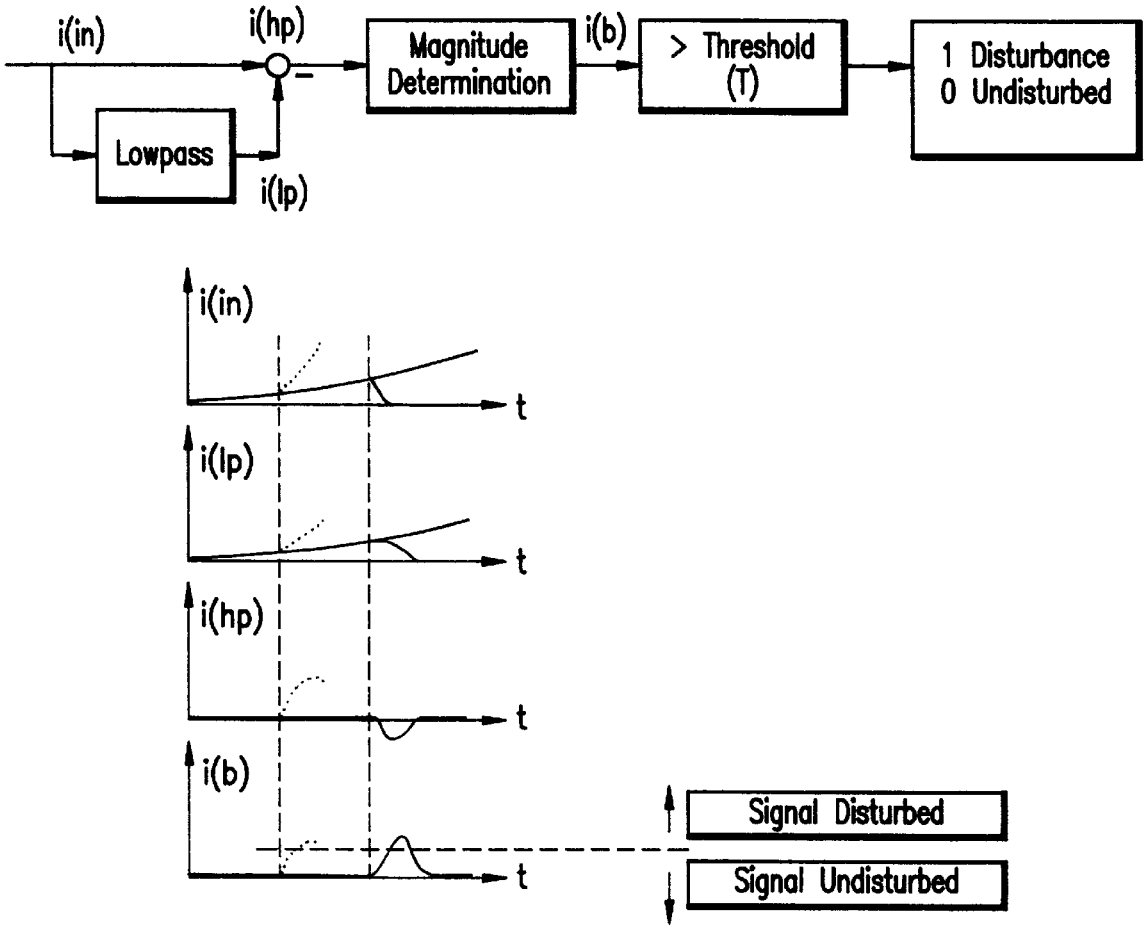

In FIG. 3, the method steps are shown schematically to show the comparison of the time-dependent traces of the motor current, which is supplied to the motor of the overpressure pump 50 and the time-dependent traces of the motor currents between the individual steps.

In FIG. 2, reference numeral II identifies the time-dependent trace of the motor current where the solid line (a) is the undisturbed trace which is detected for an operational tank-venting system, that is, a tank-venting system which is not disturbed by a leak; and, the curve identified by the dotted line (b) shows the time-dependent trace of the motor current which is present when there is a tanking operation and the dotted line (c) is the time-dependent trace of the motor current where the tank cap is opened but without fuel being supplied.

The comparison is on the basis of the basic idea that higher-frequency components are filtered out of the low-frequency motor current and are compared to a pregiven threshold.

As shown in FIG. 3, the motor current identified in FIG. 3 as i(in) is supplied to a lowpass filter. The current i(lp)

outputted by the lowpass filter is subtracted from the input current i(in) supplied to the lowpass so that a high-pass filtered current i(hp) results. The magnitude of this current is determined and the current i(b), which results therefrom, is compared to a threshold. If the current i(b) exceeds a pregiven threshold T, then the signal is disturbed and no reliable check of the operability of the tank-venting system can be made. If the current i(b) lies below the threshold, then the signal is undisturbed and a check of the operability of the tank-venting system can be made.

If, for example, the tank cap is opened before the start of the diagnosis and the actual tanking operation (that is, the inflow of fuel) takes place only later after completion of the diagnosis which, for example, can be the case when the driver opens the tank cap but does not immediately fill the tank but instead takes time and buys a newspaper or the like and only then tanks the vehicle, then, during the actual diagnosis, neither a tanking operation nor the opening of the tank cap (curve traces b and c in FIG. 2) can be determined.

Also in these cases, no leak is present and the output and storage of a fault announcement must be inhibited. For this reason, the following procedure is followed. A tightness check of the tank-venting system is undertaken in a first standstill phase of the vehicle.

In a following second standstill phase of the vehicle, a renewed tightness check of the tank-venting system is undertaken. A fault announcement is only outputted and stored when in both phases, a conclusion is drawn as to the presence of a leak and when, between the two sequential standstills of the vehicle, one of the following does not exceed a predetermined threshold: the fuel consumption, the distance traveled or another index, which permits the conclusion to be drawn that no tanking operation is taking place during the second standstill.

With this method, it is, in other words, possible that even an improper operation of the vehicle (for example, leaving the tank cap off too long) can be distinguished from an actual leak which is present. A leak is signaled and stored (that is, a fault announcement takes place) only when the detection of a leak is verified in the manner described above also in a second vehicle standstill.

In the above description, the motor current of the pump motor of the pressure source is used as an operating characteristic variable. It is understood that any other operating characteristic variable can be used which makes possible the detection of the pressure changes in the tank-venting system. Furthermore, it is also possible to use several operating characteristic variables.

It is understood that the foregoing description is that of the preferred embodiments of the invention and that various changes and modifications may be made thereto without departing from the spirit and scope of the invention as defined in the appended claims.

What is claimed is:

1. A method of checking the operability of a tank-venting system of a motor vehicle, the tank-venting system including a tank, an adsorption filter and a tank-venting valve, the adsorption filter having a venting line and being connected to the tank via a connecting line, the tank-venting valve being connected to the adsorption filter via a valve line, the method comprising the steps of:

utilizing a pressure source to introduce a pressure into said tank-venting system which is an overpressure compared to atmospheric pressure and said system or said pressure source having at least one operating variable which can be detected;

providing a stored reference time-dependent trace of said one variable which is characteristic for a diagnostic trace;

detecting said operating variable while introducing said overpressure during a first standstill of said vehicle to form a first time-dependent trace of said one variable and determining whether a leak is present;

detecting said operating variable while introducing said overpressure during a second standstill of said vehicle to form a second time-dependent trace of said one variable and determining whether a leak is present;

comparing said first and second time-dependent traces to said stored reference time-dependent trace;

outputting a fault announcement only when:

(a) a conclusion is drawn as to the presence of a leak from both of said first and second time-dependent traces and when said first and second traces deviate from said stored reference time-dependent trace by a pregiven value; and, (b) when, between said first and second standstills of said vehicle, one of the following does not exceed a predetermined threshold:

(i) fuel consumption;

(ii) distance traveled; or, (iii) another index which permits a conclusion to be drawn that no tanking operation is taking place during said second standstill.

2. The method of claim 1, wherein said pressure source includes an overpressure pump supplied with an electric current and said operating variable being said electric current.

3. A method of checking the operability of a tank-venting system of a motor vehicle, the tank-venting system including a tank, an adsorption filter and a tank-venting valve, the adsorption filter having a venting line and being connected to the tank via a connecting line, the tank-venting valve being connected to the adsorption filter via a valve line, the method comprising the steps of:

utilizing a pressure source to introduce a pressure into said tank-venting system which is an overpressure compared to atmospheric pressure and said pressure source having at least one operating variable;

providing a first time-dependent trace of said one variable which is characteristic for a diagnostic trace undisturbed by a tanking operation;

detecting a second time-dependent trace of said one variable during standstill of said vehicle;

comparing said second time-dependent trace to said first time-dependent trace; and, inhibiting an output of a fault announcement when said second time-dependent trace deviates from said first time-dependent trace by a pregiven value.

4. The method of claim 3, wherein said first time-dependent trace is obtained by estimation, computation or measurement.

5. The method of claim 3, wherein said pressure source includes an overpressure pump supplied with an electric current and said operating variable being said electric current.

* * * * *